US005667714A

United States Patent [19]

Cho

[11] Patent Number: 5,667,714

[45] Date of Patent: Sep. 16, 1997

[54] MICROWAVE OVEN HAVING VERTICALLY RECIPROCABLE TURN TABLE

[75] Inventor: Byung-Jae Cho, Seoul, Rep. of Korea

[73] Assignee: Samsung Electronics Co., Ltd., Suwon, Rep. of Korea

[21] Appl. No.: 662,017

[22] Filed: Jun. 12, 1996

[30] Foreign Application Priority Data

Jun. 12, 1995 [KR] Rep. of Korea ..... 95-13164 U
May 4, 1996 [KR] Rep. of Korea ..... 96-10833 U

[51] Int. Cl.[6] ..... H05B 6/78

[52] U.S. Cl. ..... 219/753; 219/754; 219/762

[58] Field of Search ..... 219/753, 752, 219/754, 755, 762, 763; 108/20, 139, 138; 126/338; 99/443 R, DIG. 14

[56] References Cited

U.S. PATENT DOCUMENTS 3,436,506 4/1969 Smith ..... 219/753
4,725,703 2/1988 Park ..... 219/753
4,742,202 5/1988 Campbell et al. ..... 219/753
4,757,173 7/1988 Park ..... 219/753

*Primary Examiner*—Philip H. Leung
*Attorney, Agent, or Firm*—Burns, Doane, Swecker & Mathis, L.L.P.

[57] ABSTRACT

A microwave oven includes a turntable rotatable about a vertical axis. A drive mechanism rotates the turntable while moving it up and down to accomplish a more uniform cooking. The drive mechanism includes a stationary cam, and a rotatable cam seated on the stationary cam and rotated by a motor. As the rotatable cam rotates upon the stationary cam, it moves up and down and moves the turntable up and down.

8 Claims, 4 Drawing Sheets

MICROWAVE OVEN HAVING VERTICALLY RECIPROCABLE TURN TABLE

BACKGROUND OF THE INVENTION

1. FIELD OF THE INVENTION

The present invention relates to a turn table moving apparatus of a microwave oven.

2. DESCRIPTION OF THE PRIOR ART

As is illustrated in FIG. 1, a turn table moving apparatus of a microwave oven according to the prior art includes a cooking chamber 2A to accommodate the food in a body 1*a*, a turn table 5A for being releasably disposed on a floor 3A of the cooking chamber to support and rotate the food and driving means 7A for being arranged beneath the floor to rotatably drive the turn table.

The driving means 7A, as illustrated in FIG. 1, includes a motor 9A for providing a power to rotate the turn table, a motor axle 11A mounted at one side of the motor 9 and projecting through the floor for rotation of the turn table 5, and a coupling member 13A for being disposed at an upper side of the motor axle 11A to thereby couple the motor axle 11A to the turn table However, there is a problem in the turn table moving apparatus of a microwave oven according to the prior art thus constructed, in that the turn table is not vertically moved but only moved rotatably to thereby prevent the food form receiving heat in an even fashion and to leave the food partially uncooked.

There is another problem in that the food gets burnt when an operation time of the microwave oven is prolonged to continuously cook the food.

SUMMARY OF THE INVENTION

Accordingly, the present invention is provided to solve the afore-mentioned problem and it is an object of the present invention to provide a turn table moving apparatus of a microwave oven by which the turn table can be rotated and at the same time can be vertically moved to heat and cook the food evenly.

In accordance with the object of the present invention, there is provided a turn table moving apparatus of a microwave oven, the apparatus comprising:

a lower cam for being fixedly disposed at one side of the motor; and an upper cam for being mounted at an upper side of the lower cam and for being moved along a cam surface formed at an upper surface of the lower cam according to rotation of a motor axis in order to move the turn table vertically.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF A PREFERRED EMBODIMENT THE INVENTION

A turn table moving apparatus of a microwave oven according to the preferred embodiment of the present invention will be described in detail with reference to the accompanying drawings.

Figure 1:
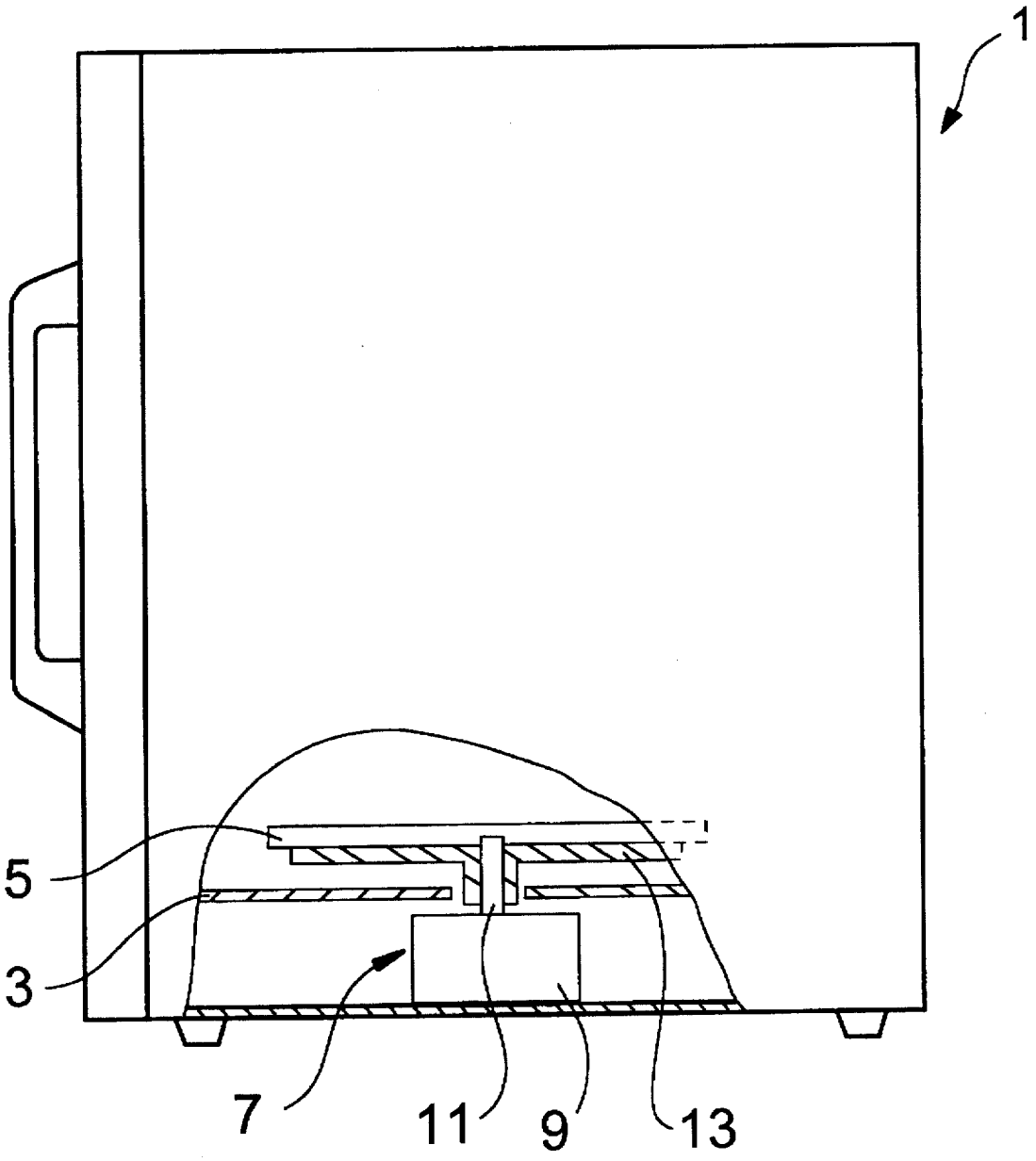
FIG. 1 PRIOR ART
FIG. 1 is a partially broken away side elevational view for illustrating a turn table apparatus of a microwave oven according to the prior art.
Figure 2:
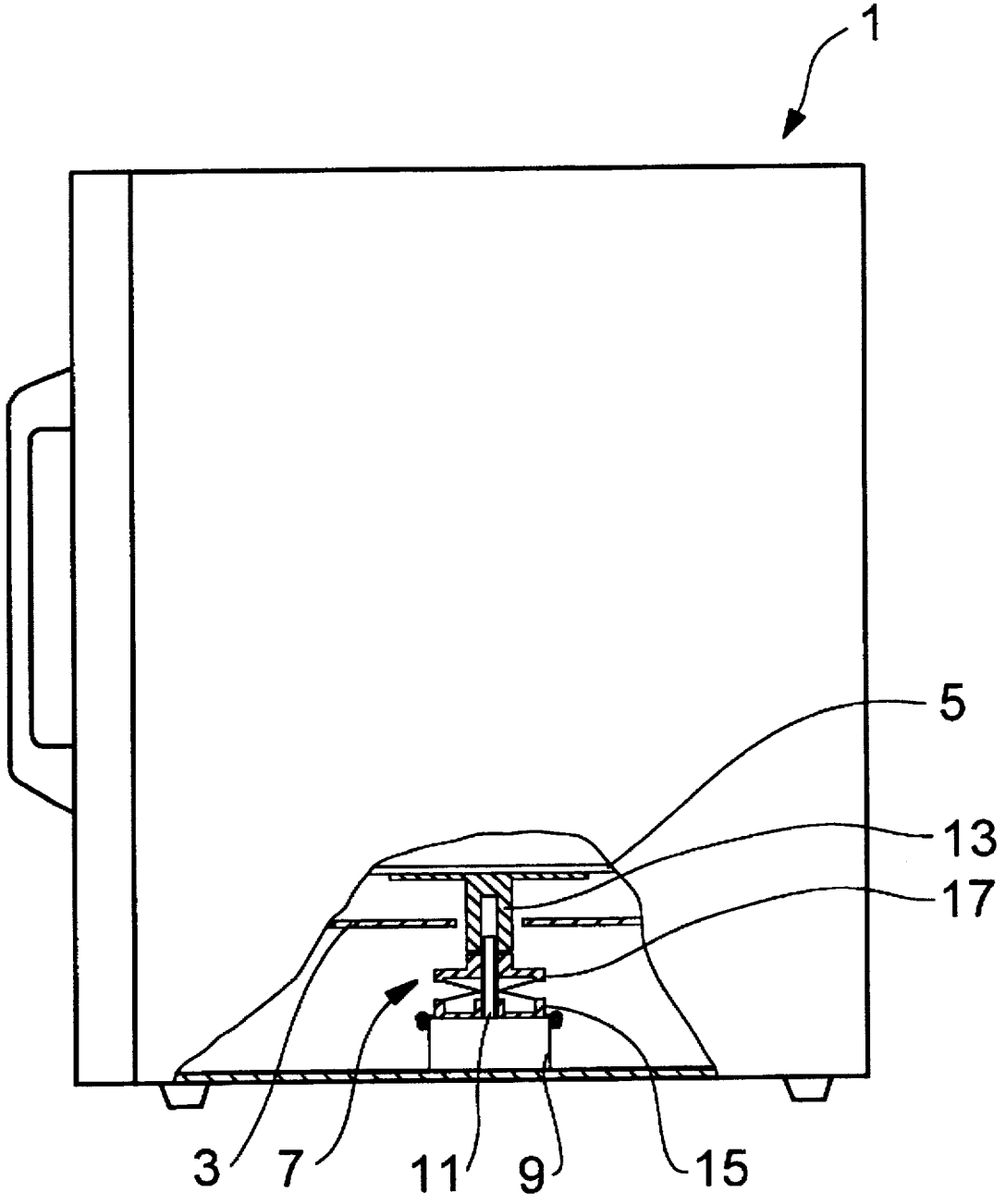
FIG. 2 is a partially broken away side elevational view of a turn table moving apparatus of a microwave oven according to an embodiment of the present invention.

A turn table moving apparatus of a microwave oven according to the present invention, as illustrated in FIG. 2, includes a cooking chamber 2 to accommodate the food in a body 1, a turn table 5 for being releasably disposed on a floor 3 of the cooking chamber to support and rotate the food and driving means 7 for being arranged beneath the floor 3 to rotatably drive the turn table 5.

Figure 3:
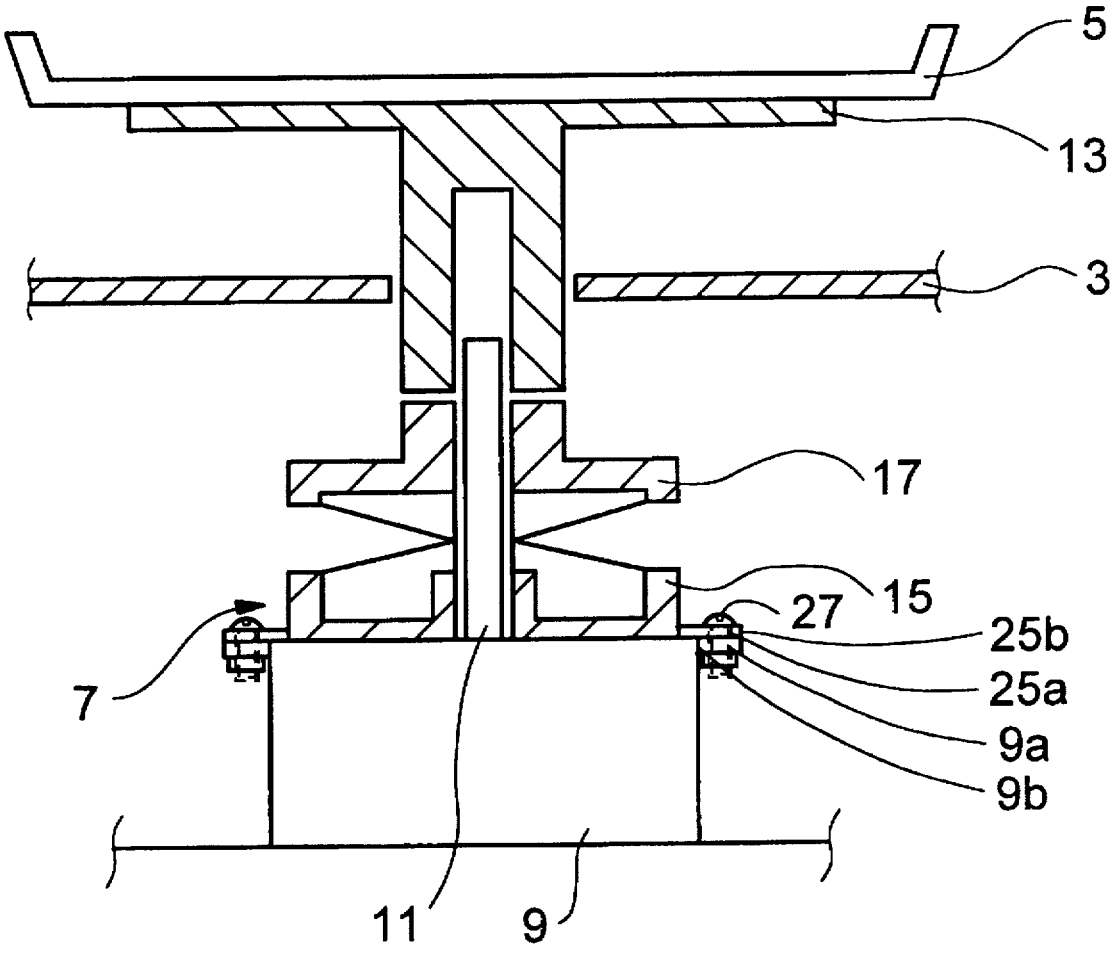
FIG. 3 is a sectional view of the turn table driving means depicted in FIG. 2.

The driving means 7 includes, as illustrated in FIG. 3, a motor 9 disposed on a floor 8 of the body 1, a motor axle or drive shaft 11 centrally disposed in the motor and for being rotated according to an activation of the motor 9 to thereby rotate the turn table 5, a lower cam 15 fixedly disposed on an upper side of the motor 9 an upper cam rotatably disposed on an upper surface of the lower cam 15 to vertically move the turn table 5, and a coupling member 13 connected to an upper side of the motor axle 11 and to a lower surface of the turn table 5 to thereby rotate the turn table 5.

Figure 4:
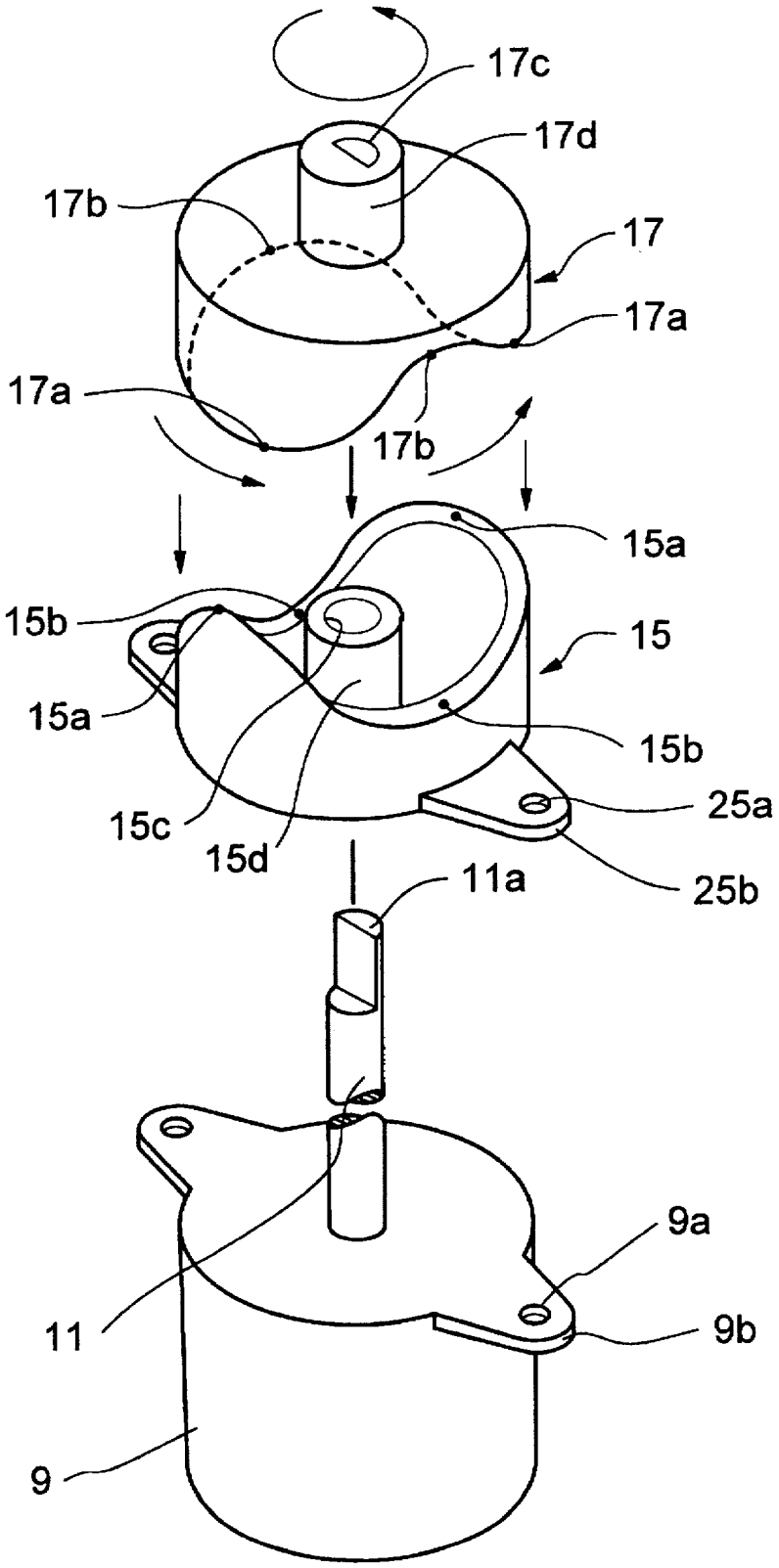
FIG. 4 is an exploded perspective view of the turn table moving apparatus depicted in FIG. 3.

The motor axle 11 is formed, as illustrated in FIG. 4, with a protruding 11*a* having a "D"-shaped form at an end unit thereof, and the lower cam 15 has its upper surface in an arch shape in order to have an upper dead center 15*a* and a bottom dead center 15*b*.

The lower cam 15 is provided with a boss unit 15*d* formed with a bore 15*c* thereon so that the motor axle 11 can be inserted therethrough.

Meanwhile, the motor 9 is provided at one side thereof with a pair of fixing units 9*b* having fixing holes 9*a* therein.

The lower cam 15 is provided with fixing units 25*b* each having a fixing hole 25*a*.

Each respective fixing unit 25*b* of the lower cam 15 and the fixing unit 9*b* of the motor 9 are integrally fixed by way of fastening means 27 as illustrated in FIG. 3.

The fixing unit 9*b* is illustrated as only being disposed at one side of the motor 9. However it should be noted that disposition of the fixing unit is not limited in this particular fashion. The fixing unit 9*b* can be disposed an a separate bracket (not shown) adjacent the motor 9, or can be fixedly arranged by a separate fixation plate (not shown).

The upper cam 17 has an arch draped lower surface as illustrated in FIG. 4, and the upper dead center 17*a* and the bottom dead center 17*b* thereof can travel on the upper surface of the lower cam 15.

Furthermore, the upper cam 17 is formed at the upper surface thereof with a boss unit 17*d* formed with a "D-shaped" insertion groove 17*c* into which the protruding unit 11*a* of the motor axle 11 is inserted, so that same can be rotated by the motor.

Next, the operation of the turn table moving apparatus of a microwave oven according to the present invention thus constructed will be described.

When an electric power is applied from an electric power supply means (not shown), the motor 9 is activated. As the motor 9 is driven, the motor axle 11 is rotated and the coupling member 13 is also rotated to thereby cause the turn table 5 to rotate.

At this time, vertical movement of the turntable is repeated as, the upper cam 17 is rotated along the upper surface of the lower cam 15 to thereby obtain a highest level when the upper dead center 17*b* of the upper cam 17 touches the upper dead center 15*a* of the lower cam 15, and to obtain a lowest level when the bottom dead center 17*b* of the upper cam 17 contacts the bottom dead center 15*b* of the lower cam 15, so that the coupling member 13 and the turntable 5 are vertically moved.

The lower cam 15 is formed with the upper dead center 15*a* and diametrically opposite bottom dead centers 15*b* and the upper cam 17 is formed with diametrically opposite upper dead centers 17*b* and diametrically opposite bottom dead centers 17*a* so that the upper cam 17 is prevented from being tilted when the upper cam 17 is rotated along the upper surface of the lower cam 15.

Accordingly, the turn table coupled to the upper surface of the upper cam 17 is not tilted and is rotated smoothly to prevent the food (not shown) disposed at the upper surface of the turn table 5 from being rocked.

The turn table 5 is therefore rotated and at the same time moved vertically to allow the food on the turn table 5 to get evenly heated during cooking.

As apparent from the foregoing, there is an advantage in the turn table moving apparatus of a microwave oven according to the present invention, in that the turn table is so structured to be rotated and moved vertically so that the food can be evenly heated and cooked.

What is claimed is:

1. A microwave oven comprising:

a body forming a cooking chamber; a turntable disposed above a floor of the cooking chamber and being mounted for rotation about a vertical axis and for up-and-down movement along the vertical axis; and a drive mechanism disposed beneath the floor and including:

a motor having a drive shaft extending through the floor along the vertical axis, the drive shaft including an upper end connected to the turntable for rotating the turntable, a first cam having a stationary first cam surface arranged annularly around the vertical axis, and a second cam having a second cam surface engaging the first cam surface, the second cam surface being annularly arranged around the vertical axis;

the turntable and second cam being operatively connected to the drive shaft to be rotated thereby, and being movable up-and-down relative to the drive shaft as the second cam surface rotates relative to the first cam surface.

2. The microwave oven according to claim 1 wherein the first cam surface faces upwardly and includes at least two upwardly projecting arches each defining an upper dead center, and spaces between the arches each defining a lower dead center.

3. The microwave oven according to claim 2 wherein the first cam further includes a center boss through which the drive shaft extends.

4. The microwave oven according to claim 2 wherein the second cam surface faces downwardly and includes at least two downwardly projecting arches each defining an upper dead center, and spaces between the downwardly projecting arches each defining a lower dead center, the arches of each cam surface being received in the spaces of the other cam surface when the turntable is in its lowest position.

5. The microwave oven according to claim 4 wherein there is a pair of arches on each of the first and second cams, the arches of each pair of arches being disposed diametrically opposite one another.

6. The microwave oven according to claim 1 wherein the first cam is fixed to an upper end of the motor.

7. The microwave oven according to claim 1 wherein the turntable and second cam constitute separate elements.

8. The microwave oven according to claim 1 wherein the drive shaft includes an upper portion of non-circular cross-section received in correspondingly shaped recesses in the second cam and the turntable.

* * * * *